United States Patent [19]

Richardson

[11] 4,330,967

[45] May 25, 1982

[54] GRINDER AND WHEEL GUARDS THEREFOR

[75] Inventor: Victor E. Richardson, Houston, Tex.

[73] Assignee: Dresser Industries, Inc., Dallas, Tex.

[21] Appl. No.: 148,328

[22] Filed: May 9, 1980

[51] Int. Cl.[3] ..... B24B 55/04

[52] U.S. Cl. ..... 51/268; 51/170 R

[58] Field of Search ..... 51/170 T, 170 PT, 170 R, 51/268, 273, 269, 274, 270, 168

[56] References Cited

U.S. PATENT DOCUMENTS

| | | | |
|---|---|---|---|
| 973,894 | 10/1910 | Toomey | 51/268 |
| 1,802,078 | 4/1931 | Exley | 51/268 X |
| 2,149,645 | 3/1939 | Sittert | 51/170 T |
| 2,441,624 | 5/1948 | Elliott | 51/168 |
| 3,312,258 | 4/1967 | Spampinato | 51/268 |
| 4,059,930 | 11/1977 | Alessio | 51/268 |
| 4,103,460 | 8/1978 | Law | 51/170 R |

FOREIGN PATENT DOCUMENTS

| | | | |
|---|---|---|---|
| 175822 | 8/1953 | Fed. Rep. of Germany | 51/268 |

*Primary Examiner*—Harold D. Whitehead
*Attorney, Agent, or Firm*—Roy L. Van Winkle

[57] ABSTRACT

The improved grinder of this invention is provided with a non-circular peripheral surface encompassing an output shaft. The non-circular peripheral surface is arranged to receive a mating hole in a grinder wheel guard. The grinder wheel guard is positioned on the grinder by means of a threaded fastener or the like and is sufficiently large to house an appropriate grinder wheel. The arrangement between the non-circular peripheral surface on the grinder and the mating hole in the grinder wheel guard provides a means for transferring any load imposed on the grinder wheel guard directly into the body or housing of the grinder.

10 Claims, 5 Drawing Figures

GRINDER AND WHEEL GUARDS THEREFOR

BACKGROUND OF THE INVENTION

This invention relates generally to improved grinders. More particularly, but not by way of limitation, this invention relates to an improved grinder and to wheel guards therefor wherein loads imposed on the wheel guards are transferred to the grinder housing.

Grinder wheel guards are provided in an effort to prevent injury to the operator of the grinder or to persons in the nearby vicinity in the event that a grinder wheel disintegrates during use. As is well known, grinder wheels rotate at relatively high speeds and thus disintegration of the wheel releases a considerable amount of energy which can cause severe damage or injury.

Wheel guards utilized on grinders in the past have been reasonably successful, but they must be made relatively light and yet sufficiently strong to absorb all of the energy that is dissipated. One of the weaker structural parts of grinding wheel guards has been in the method of attachment to the grinder housing. Most often, the grinder wheel guard is simply provided with an opening that fits around the shaft and the guard is then attached to the housing by means of threaded fasteners or the like. When a load is imposed on the wheel guard, the load is transferred directly into the threaded fasteners which may shear permitting the wheel guard to rotate and either become dislodged from the grinder or rotated about the shaft to a position wherein the operator will be exposed to fragments from the grinding wheel.

U.S. Pat. Nos. 4,059,930 issued Nov. 29, 1977 to Lorenzo Ercole Alessio and 4,103,460 issued Aug. 1, 1978 to John P. Law, each illustrates a grinder and grinder wheel guard combinations. Each of the guards that are described in the patents incorporates certain safety features, but each is attached to the grinder housing by fasteners that are subject to being sheared in the case of loads being imposed on the guard.

It is the object of this invention to provide an improved grinder and wheel guards therefor, wherein loads imposed on the wheel guard are transferred directly to the grinder housing.

SUMMARY OF THE INVENTION

This invention then provides an improved grinder wheel assembly wherein the grinder includes a housing, a rotatable output shaft journaled in the housing and having a shaft portion projecting therefrom. The shaft portion is arranged to carry a grinding wheel for rotation therewith. The improvement comprises a non-circular peripheral surface on the housing encompassing the output shaft; a wheel guard member including a mounting hole sized and arranged to fit over the peripheral surface in mating relationship thereto whereby a load imposed on the guard member is transferred into the housing through the peripheral surface; and means for positioning the guard member on the housing. In another aspect, this invention contemplates an improved grinding wheel guard for an abrasive grinder wherein the grinder includes a housing and has an output shaft journaled in the housing. The guard comprises a member having a mounting hole therein of non-circular configuration engageable with the housing whereby a load imposed on the guard member is transferred into the housing.

BRIEF DESCRIPTION OF THE DRAWING

The foregoing additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
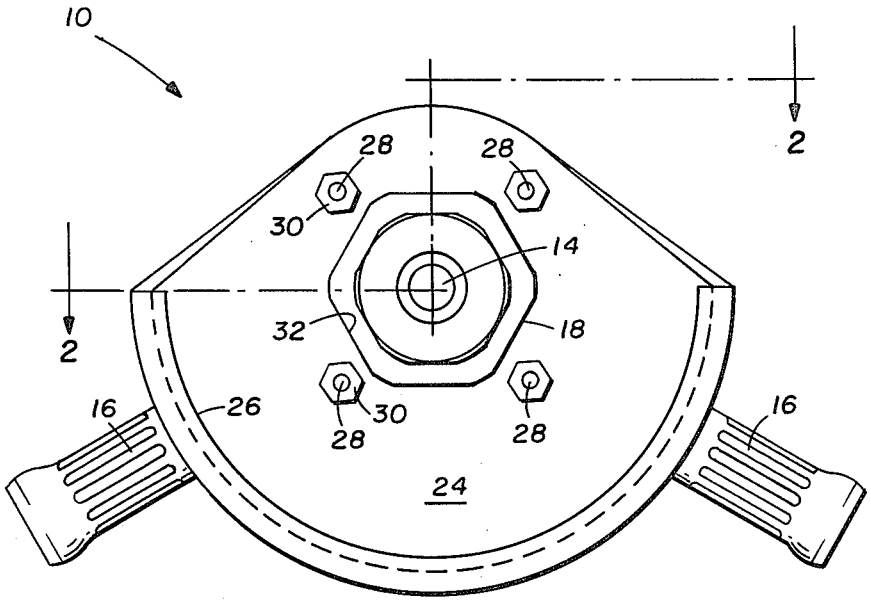
FIG. 1 is a bottom view of a grinder and wheel guard assembly constructed in accordance with the invention.
Figure 2:
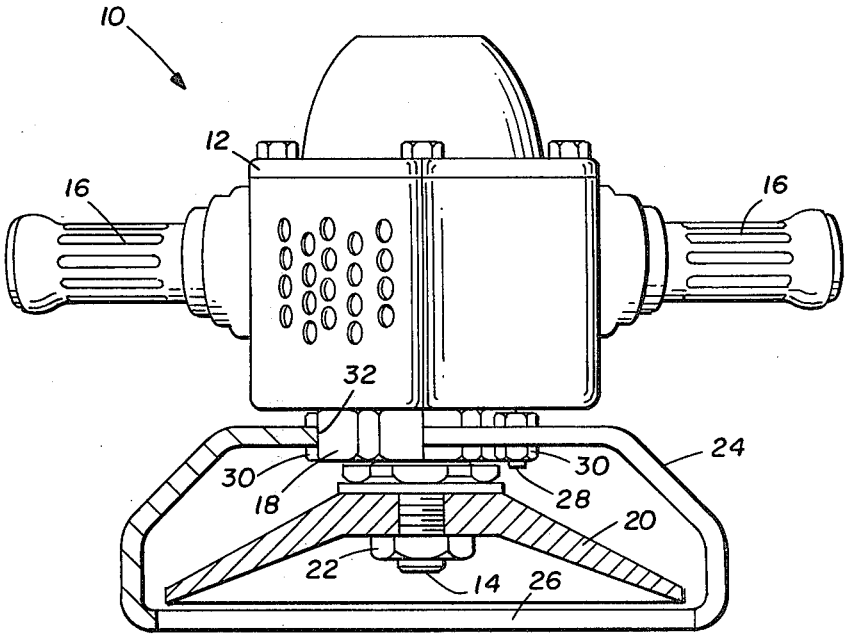
FIG. 2 is a side view of the grinder and wheel guard combination, partly in elevation and partly in cross-section, the cross-section being taken generally along the line 2—2 of FIG. 1.

Referring to the drawing in FIGS. 1 and 2, and in particular, shown therein and generally designated by the reference character 10 is a grinder that is constructed in accordance with the invention. The grinder 10 includes a housing or body 12 that is hollow and has an electric or air motor (not shown) located therein. An output shaft 14 is connected to and driven by the motor and extends from the housing 12 as shown. In the grinder 10 illustrated, a pair of handles 16 are connected to the housing 12 and project therefrom so that the operator of the grinder 10 can control the position of the grinder.

At its lowermost end portion, the housing 12 includes a non-circular peripheral surface 18 that encompasses the output shaft 14. As is shown most clearly in FIG. 1, the peripheral surface 18 is in the form of a hexagon.

Mounted on the output shaft 14 below the peripheral surface 18 is a grinding wheel 20 (not shown in FIG. 1). The griding wheel 20 is retained on the output shaft 14 by a threaded nut 22.

A grinding wheel guard 24 having a semicircular lip 26 formed on one side thereof and an opening on the opposite side thereof is positioned on the body 12 by four threaded studs 28 that are spaced around the peripheral surface 18. Each of the studs 28 is provided with a threaded nut 30 for purposes of retaining the wheel guard 24 on the grinder 10.

The wheel guard 24 is provided with a hole 32 that is sized and arranged to receive the peripheral surface 18 of the housing 12. As shown clearly in FIG. 1, the hole 32 has the configuration of an octagon to closely receive the surface 18. The relationship between the surface 18 and the hole 32 is such that the wheel guard 24 is prevented from rotating relative to the housing 12 due to the engagement of the wheel guard with the surface 18.

In operation, the grinder 10 will be connected to an appropriate power source to cause rotation of the output shaft 14 and the attached grinding wheel 20. Prior to such operation, of course, the wheel guard 24 would have been placed in position on the housing 12 with the peripheral surface 18 thereon mated with the hole 32 formed in the guard 24. The nuts 30 would have been placed on the studs 28 securing the guard 24 to the housing 12.

Under normal operation, the guard 24 serves no purpose other than to deflect away from the operator any material removed from the surface being ground and further to deflect small portions of the grinding wheel itself which may be dislodged. However, should the grinding wheel 20 disintegrate for any reason, the guard 24 must be sufficiently strong to absorb the energy released by such disintegration.

Should large chunks of the grinding wheel 20 strike the guard 24, the guard 24 cannot rotate to a position where the open side thereof will be toward the operator due to the octagonal configuration of the surface 18 and the hole 32. That is, the engagement between the peripheral surface 18 on the housing 12 with the guard 24 around the hole 32, prevents relative movement between the housing 12 and guard 24. The studs 28 also aid in preventing such rotation, but it should be pointed out that the main force is transmitted into the housing 12 through the octagonal configuration of the surfaces. Thus, and since the guard 24 cannot rotate on the housing 12, it is believed that a much safer guard is provided to prevent inadvertent injury to the operator of the grinder 10.

DESCRIPTION OF THE EMBODIMENT OF FIG. 3

Figure 3:
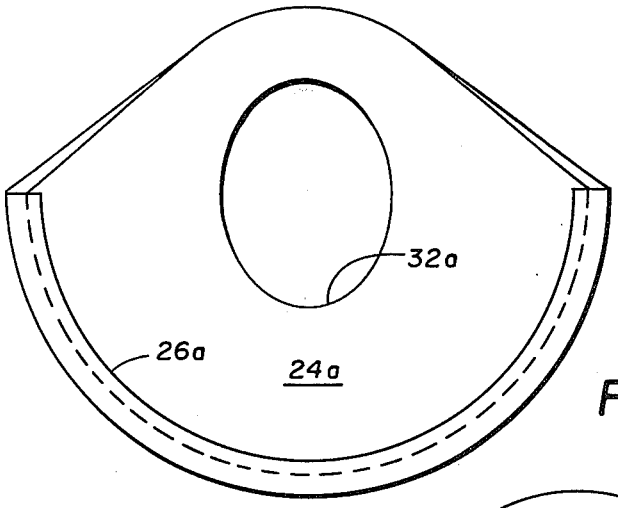
FIG. 3 is a view similar to FIG. 1, but illustrating another arrangement of guard that is also constructed in accordance with the invention.

The wheel guard 24*a* illustrated in FIG. 3 is essentially identical to the wheel guard 24 illustrated in FIG. 1. However, it should be pointed out that instead of the octagonal hole 32 formed in the wheel guard 24, the wheel guard 24*a* includes an elliptical or oval-shaped opening 32*a*. Manifestly, it will be necessary for the grinder upon which the guard 24*a* is to be mounted to have a mating peripheral surface thereon that will fit into the opening 32*a*. The opening 32*a* is a non-circular in configuration and as such, it will be effective in preventing the rotation of the guard 24 relative to the housing 12.

DESCRIPTION OF THE EMBODIMENT IN FIG. 4

Figure 4:
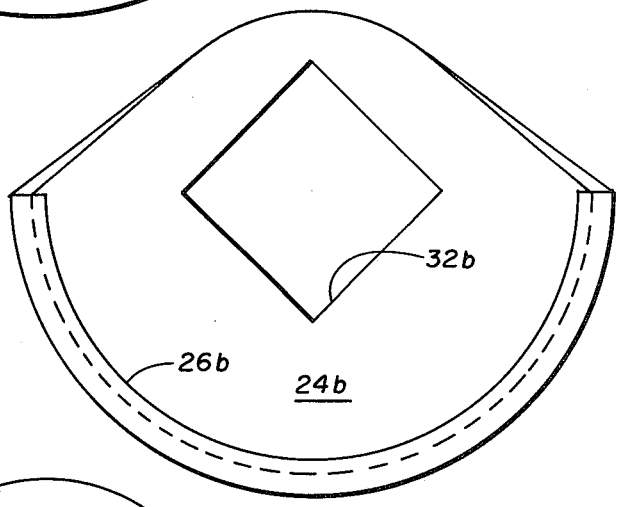
FIG. 4 is also a view similar to FIG. 1, but illustrating another embodiment of guard that is also constructed in accordance with the invention.

Again, the guard 24*b* illustrated in FIG. 4 is substantially identical to the guard 24 illustrated in FIG. 1. However, it will be noted that the opening 32*b* in the guard 24*b* is square rather than octagonal as illustrated in FIG. 1.

It should be apparent that the rectangular or square opening 32*b* when used in conjunction with a grinder 10 having a peripheral surface that mates with the opening 32*b* will be effective to prevent rotation of the guard 24*b* since the forces imposed on the guard 24*b* will be transferred directly into the grinder housing.

DESCRIPTION OF THE EMBODIMENT IN FIG. 5

Figure 5:
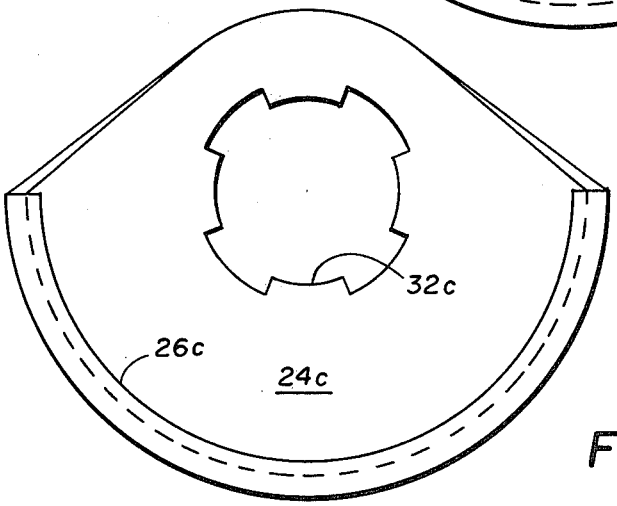
FIG. 5 is a view similar to FIG. 1, but illustrating another guard that is also constructed in accordance with the invention.

The wheel guard 24*c* illustrated in FIG. 5 is also substantially identical to the wheel guard illustrated in FIG. 1. The notable exception being the configuration of the opening 32*c* as compared to the hexagonal opening 32 formed in the wheel guard 24. The opening 32*c* may be described as being splined and when mated with a corresponding outer peripheral surface on the grinder housing will prevent rotation of the wheel guard 24*c* relative to the housing. One additional advantage of having a series of splines in the opening 32*c* and on the grinder housing, when combined with appropriate stud holes in the wheel guard 24*c*, is that the wheel guard 24*c* can be rotated to a number of positions relative to the grinder 10 if such is desired.

From the foregoing, it can be seen that the various configurations of wheel guards described hereinbefore are effective when used in combination with a grinder 10 having a mating outer peripheral surface, to prevent rotation of the wheel guard relative to the housing in the event that forces are imposed on the wheel guard. Thus, the wheel guards described will be effective in avoiding injury to the operator or persons in the vicinity of the grinder 10 should the grinder wheel disintegrate for any reason.

The embodiments described in detail hereinbefore, are provided by way of example only and it will be understood that many changes and modifications can be made thereto without departing from the spirit or scope of the invention.

The embodiments of the invention in which an exclusive property or privilege is claimed are defined as follows:

1. An improved grinder and wheel guard assembly wherein said grinder includes a housing, a rotatable output shaft journaled in the housing and having a shaft portion projecting therefrom, the shaft portion being arranged to carry a grinding wheel for rotation therewith, the improvement comprising:

a non-circular peripheral surface on the housing encompassing the output shaft;

a wheel guard member including a mounting hole sized and arranged to fit over said peripheral surface in essentially coterminous relationship thereto, whereby a load imposed on said guard member is transferred into the housing through said peripheral surface; and, mounting means positioning said guard member on the housing.

2. The grinder of claim 1 wherein said peripheral surface is polygonal.

3. The grinder of claim 2 wherein said peripheral surface is hexagonal.

4. The grinder of claim 2 wherein said peripheral surface includes a plurality of spline-like portions.

5. The grinder of claim 1 wherein said mounting means includes a threaded fastener connected to the housing and extending through said guard member.

6. The grinder of claim 1 wherein said mounting means includes a plurality of threaded studs carried by the housing extending through said guard member and a nut for each stud threaded thereon to securely position said guard member on the housing.

7. An improved grinding wheel guard for an abrasive grinder wherein said grinder includes a housing and an output shaft journaled in the housing, a non-circular peripheral portion on the housing, said guard comprising a wheel guard member having a mounting hole therein of a non-circular configuration arranged to be essentially coterminous with and engageable with the peripheral portion in the housing whereby a load imposed on said guard member is transferred into the housing.

8. The guard of claim 7 wherein said mounting hole is polygonal.

9. The guard of claim 8 wherein said mounting hole is hexagonal.

10. The guard of claim 8 wherein said mounting hole includes a plurality of spline-like projections.

* * * * *